US011377890B1

(12) United States Patent
Gore et al.

(10) Patent No.: US 11,377,890 B1
(45) Date of Patent: Jul. 5, 2022

(54) APPLIANCE DOOR HINGE ASSEMBLY

(71) Applicant: WHIRLPOOL CORPORATION, Benton Harbor, MI (US)

(72) Inventors: Rohan Gajananrao Gore, Stevensville, MI (US); Brian Scott White, Galion, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/139,327

(22) Filed: Dec. 31, 2020

(51) Int. Cl.
*E05D 15/50* (2006.01)
*E05D 7/10* (2006.01)

(52) U.S. Cl.
CPC ..... *E05D 7/10* (2013.01); *E05Y 2900/308* (2013.01)

(58) Field of Classification Search
CPC ..... E05Y 2900/30; E05Y 2900/606; E05Y 2900/308; E05D 11/1064; E05D 7/10; E05D 7/1055; E05D 7/1022; E05D 7/105; E05F 1/12; E05F 3/20; E05F 5/02
See application file for complete search history.

(56) References Cited

U.S. PATENT DOCUMENTS 4,817,240 A 4/1989 Sovis, Jr. et al.
6,035,848 A * 3/2000 Ray ..... F24C 15/022 126/194
6,397,836 B1 6/2002 Pelletier et al.
6,539,581 B1 4/2003 Faringosi
7,134,169 B2 11/2006 Habegger et al.
7,275,283 B2 10/2007 Kistner et al.
7,721,388 B2 5/2010 Lee
7,895,998 B2 3/2011 Lee
9,347,674 B2 5/2016 Edwards et al.
9,404,299 B2 8/2016 Braden et al.
9,958,166 B2 5/2018 Braden et al.
10,451,291 B2 10/2019 White et al.
2007/0119021 A1* 5/2007 Habegger ..... F24C 15/023 16/297
2008/0289144 A1* 11/2008 Vanini ..... F24C 15/023 16/221
2010/0212112 A1* 8/2010 Steurer ..... E05F 1/1261 16/286

(Continued)

FOREIGN PATENT DOCUMENTS

CN 204960609 U * 1/2016
EP 2952664 A1 * 12/2015 ..... E05D 7/12
KR 101493165 B1 * 2/2015

*Primary Examiner* — Chuck Y Mah
(74) *Attorney, Agent, or Firm* — Price Heneveld LLP

(57) ABSTRACT

An appliance includes an appliance body having a front panel defining a connector slot. A hinge receiver is coupled with the appliance body and has opposing side walls defining a receiving space therebetween. The hinge receiver includes a first striker positioned above a second striker. The first and second strikers are aligned with the connector slot. A hinge arm assembly includes a hinge arm configured to engage with the second striker and a latch cam hingedly coupled with the hinge arm. The latch cam is movable between an engaged position and a disengaged position, and a top surface of the latch cam abuts the first striker in the engaged position. A door is rotatably coupled with the appliance body by the hinge receiver and the hinge assembly and is rotatable about a door axis between open and closed positions.

17 Claims, 7 Drawing Sheets

(56) References Cited

U.S. PATENT DOCUMENTS

| | | | | |
|---|---|---|---|---|
| 2010/0229345 | A1* | 9/2010 | Donoho | E05F 1/1276 16/374 |
| 2010/0251521 | A1* | 10/2010 | Donoho | E05D 11/06 16/343 |
| 2011/0037364 | A1* | 2/2011 | Vanini | F24C 15/023 312/327 |
| 2014/0208542 | A1* | 7/2014 | White | F24C 15/023 16/261 |
| 2019/0353353 | A1* | 11/2019 | White | E05D 3/12 |
| 2020/0263467 | A1* | 8/2020 | White | E05F 1/1261 |

* cited by examiner

APPLIANCE DOOR HINGE ASSEMBLY

FIELD OF DISCLOSURE

The present disclosure generally relates to a hinge assembly, and more specifically, to a hinge assembly for an appliance door.

BACKGROUND

Hinge assemblies are used on appliances to couple doors with cabinets. Often these hinge assemblies have various coupling assemblies for coupling components of the hinge assembly with a body of the appliance and/or the door.

SUMMARY OF THE DISCLOSURE

According to one aspect of the present disclosure, an appliance includes an appliance body having a front panel defining a connector slot. A hinge receiver is coupled with the appliance body and has opposing side walls defining a receiving space therebetween. The hinge receiver includes a first striker positioned above a second striker. The first and second strikers are aligned with the connector slot. A hinge arm assembly includes a hinge arm configured to engage with the second striker and a latch cam hingedly coupled with the hinge arm. The latch cam is movable between an engaged position and a disengaged position, and a top surface of the latch cam abuts the first striker in the engaged position. A door is rotatably coupled with the appliance body by the hinge receiver and the hinge arm assembly and is rotatable about a door axis between open and closed positions.

According to another aspect of the present disclosure an appliance includes an appliance body having a front panel defining a connector slot. A hinge receiver is coupled with the front panel and includes first and second strikers aligned with the connector slot. The first striker is positioned above and forward of the second striker. A door is coupled with the appliance body and is movable between open and closed positions. A hinge arm is coupled with the door, and a hinge arm is coupled with the hinge arm and configured to engage with the second striker. A latch cam is operably coupled with the hinge arm and is movable between an engaged position and a disengaged position. A top surface of the latch cam abuts the first striker in the engaged position.

According to yet another aspect of the present disclosure, a hinge assembly for an appliance includes a hinge receiver including first and second strikers. The first striker is positioned above and forward of the second striker. A hinge arm defines a receiving space configured to receive the second striker. A hinge arm is rotatably coupled with the hinge arm, and a latch cam is operably coupled with the hinge arm. The latch cam is movable between an engaged position and a disengaged position. A top surface of the latch cam abuts the first striker in the engaged position.

These and other features, advantages, and objects of the present disclosure will be further understood and appreciated by those skilled in the art by reference to the following specification, claims, and appended drawings.

Figure 1:
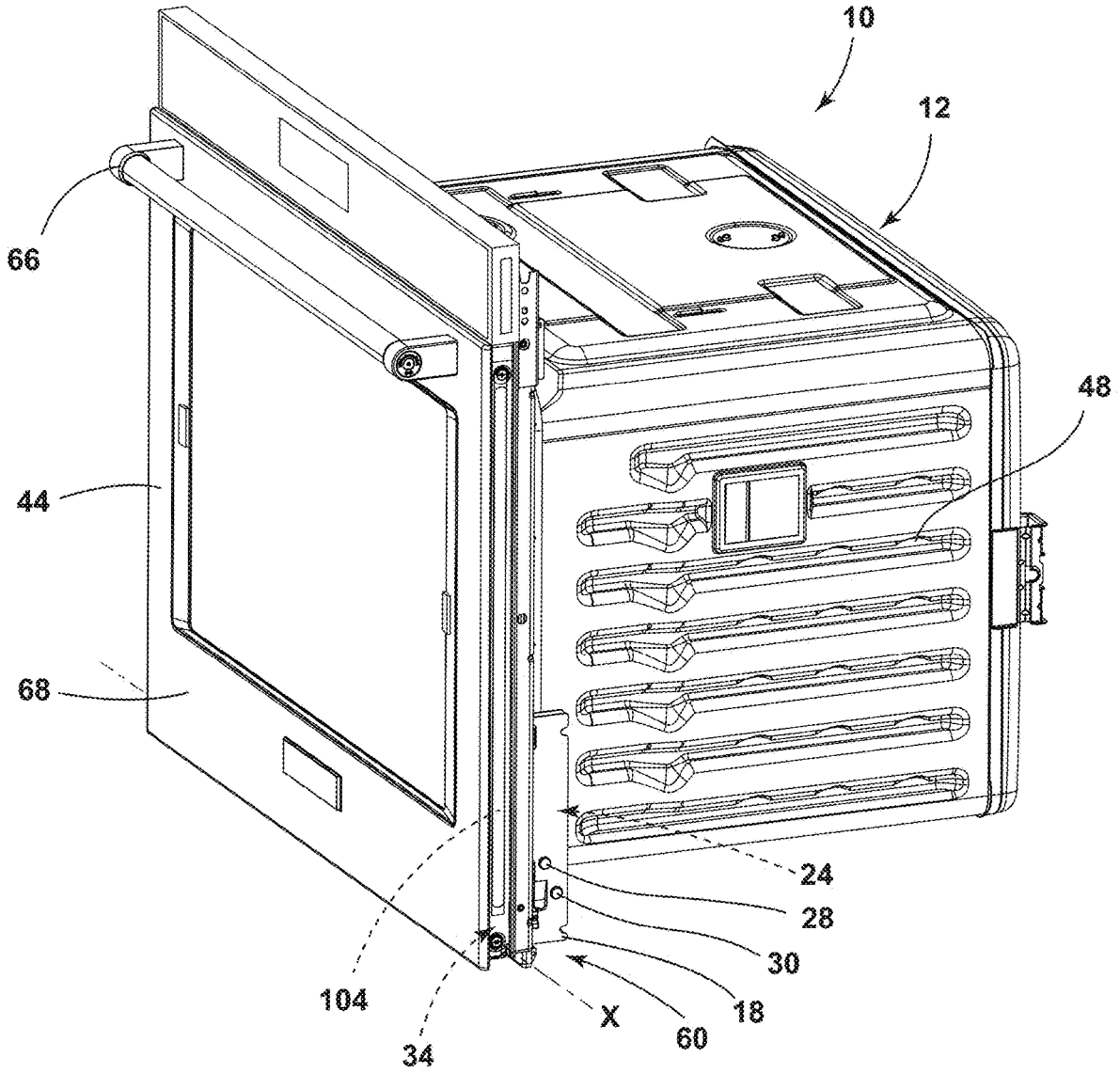
FIG. 1 is a side perspective view of a cooking appliance including a door coupled with the appliance by a hinge assembly and in a closed position, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to a hinge assembly for an appliance door. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-7, reference numeral 10 generally designates an appliance including an appliance body 12. The appliance body 12 includes a front panel 14 defining a connector slot 16. A hinge receiver 18 is coupled with the appliance body 12 and has first and second opposing side walls 20, 22. The first and second side walls 20, 22 define a receiving space 24 therebetween. The hinge receiver 18 includes a first striker 28 positioned above a second striker 30, and the first and second strikers 28, 30 are aligned with the connector slot 16. A hinge arm assembly 34 includes a hinge arm 36 configured to engage with the second striker 30. A latch cam 38 is hingedly coupled with the hinge arm 36 and is movable between an engaged position and a disengaged position. A top surface 40 of the latch cam 38 contacts the first striker 28 when the latch cam 38 is in the engaged position. A door 44 is rotatably coupled with the appliance body 12 by the hinge receiver 18 and the hinge arm assembly 34. The door 44 is rotatable about a door axis X and movable between open and closed positions.

Figure 2:
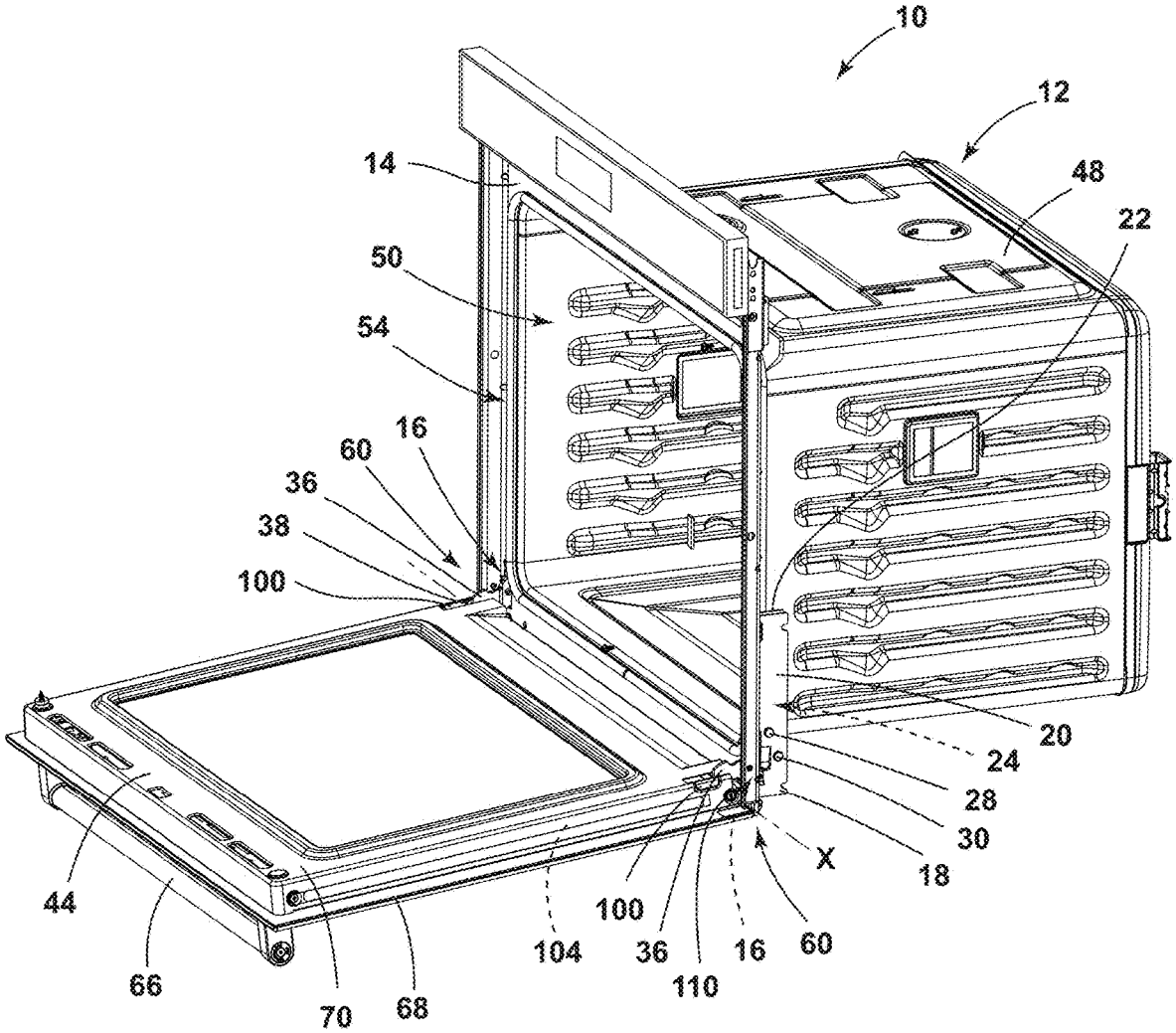
FIG. 2 is a side perspective view of the cooking appliance of FIG. 1 with the door in an open position.

Referring now to FIGS. 1 and 2, the appliance 10 is illustrated including the appliance body 12 with a liner 48 defining a cavity 50. The liner 48 is coupled with the front panel 14 of the appliance body 12, and the front panel 14 defines an access opening 54 in communication with the cavity 50, The front panel 14 further defines a pair of connector slots 16 positioned on opposing sides of the opening 54. Each connector slot 16 may be elongated and may extend parallel to side walls of the liner 48. Each connector slot 16 is configured to at least partially receive one of a pair of hinge assemblies 60, as discussed in more detail elsewhere herein. It will be understood that the appliance body 12 may further include components typically found in a conventional cooking oven, such as an outer casing, electrical components, heating elements, gas lines, valves, control units, burner elements, broiled elements, and the like. Such components will not be described further herein except where necessary for a complete understanding of the aspects of the present disclosure.

Figure 3:
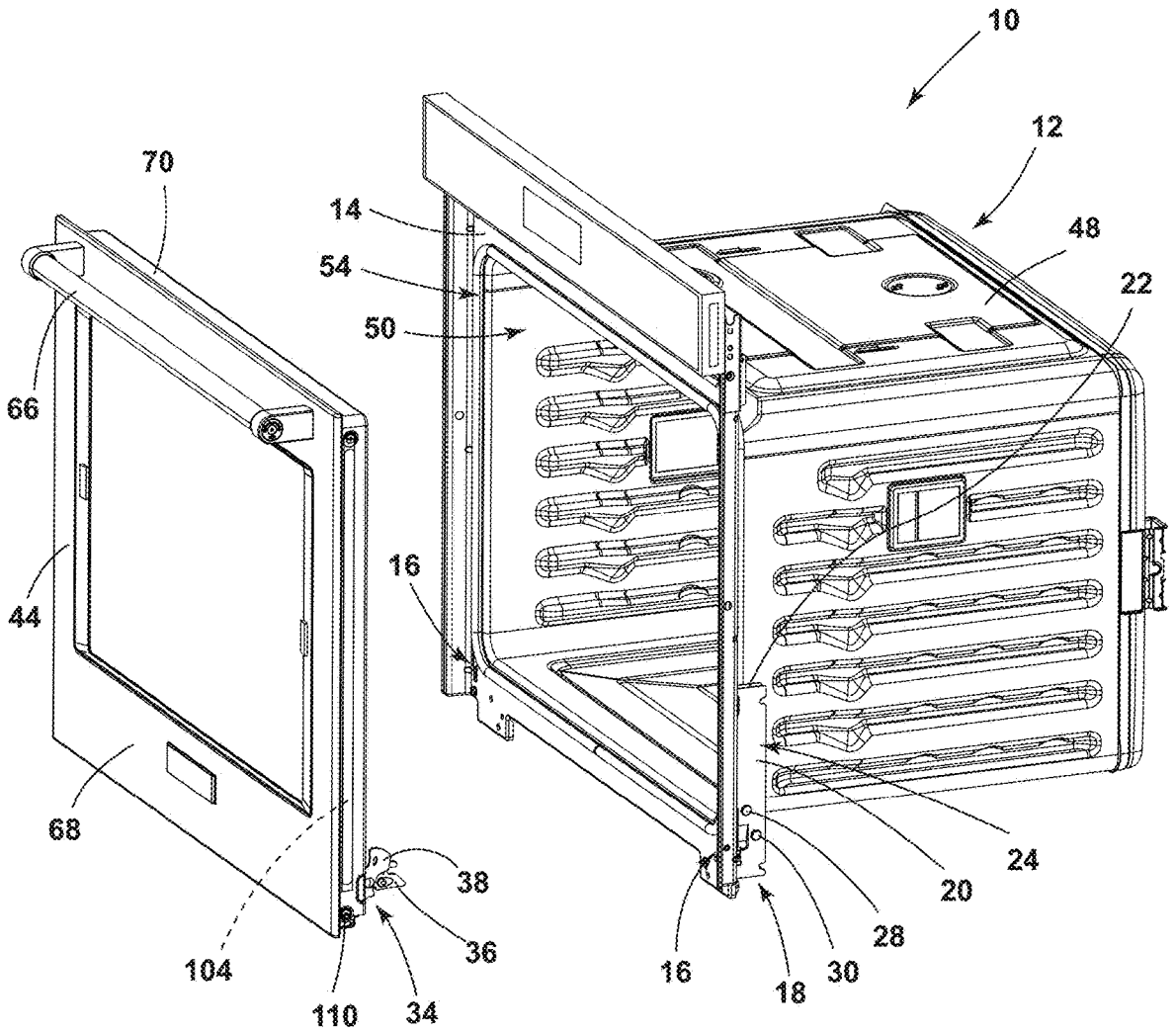
FIG. 3 is a side perspective view of the cooking appliance of FIG. 1 with the door removed.

Referring now to FIGS. 1-3, an exemplary form of the door 44 is illustrated configured to be coupled with the appliance body 12 by a pair of hinge assemblies 60. The door 44 is configured to selectively seal the cavity 50 and is movable between open and closed positions. When the door 44 is in the open position, the cavity 50 is accessible through the opening 54 defined by a front panel 14 of the appliance body 12. The door 44 includes a front door panel 68 and a rear door panel 70 in a spaced apart configuration to define a space therebetween. A handle 66 is coupled with the front door panel 68 and configured to move the door 44 between the open position and the closed position. It will be understood that the door 44 may include any number of panels without departing from the scope of the present disclosure. While the door 44 is illustrated as being configured to be coupled to the appliance body 12 by a pair of hinge assemblies 60, for the remainder of the disclosure only one of the hinge assemblies 60 is described in detail, and it will be further understood that each of the pair of hinge assemblies 60 is formed in the same or a similar way with the same components.

As shown in FIGS. 1-3, the hinge assembly 60 includes a hinge receiver 18 and a hinge arm assembly 34. The hinge receiver 18 is positioned proximate the respective connector slot 16 and is configured to be engaged with the hinge arm assembly 34 to operably couple the door 44 with the appliance body 12. The hinge arm assembly 34 is coupled with the door 44 and includes the hinge arm 36 configured to be engaged with the respective hinge receiver 18 and the latch cam 38 configured to be positioned within and/or through the connector slot 16.

Figure 4:
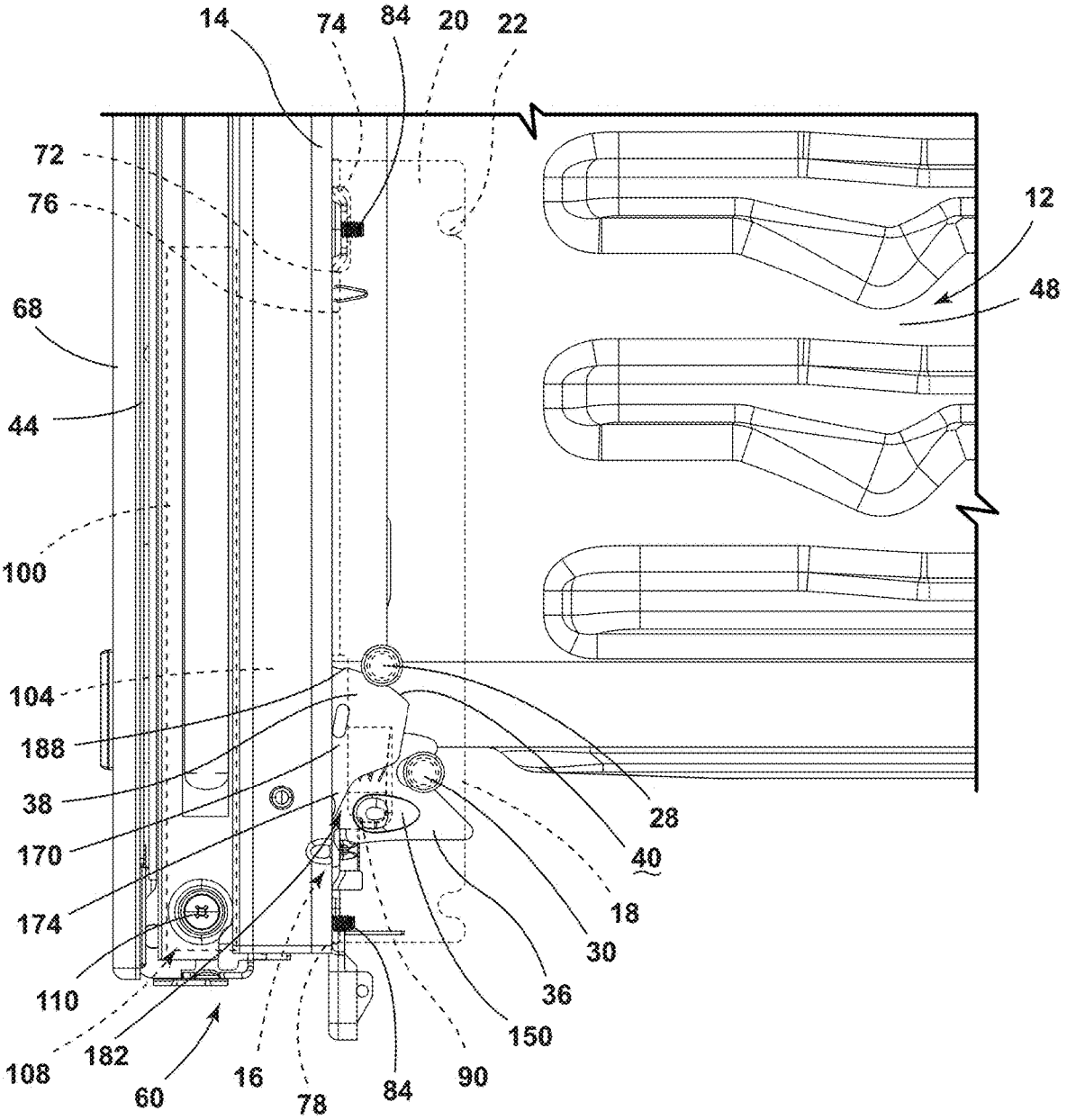
FIG. 4 is a partial side profile view of the cooking appliance and door of FIG. 1 with a hinge receiver of the hinge assembly shown in phantom.

Referring now to FIGS. 3 and 4, the hinge receiver 18 is coupled with the front panel 14 and is positioned to at least partially align with the connector slot 16. The hinge receiver 18 is generally elongated and includes first and second side walls 20, 22 positioned on opposing sides of the respective connector slot 16. The first and second side walls 20, 22 define a receiving space 24 therebetween configured to be in communication with the connector slot 16 and at least partially receive the hinge arm 36 of the hinge arm assembly 34.

As best shown in FIG. 4, the hinge receiver 18 may include a front wall 72 extending between the first and second side walls 20, 22. In various examples, the front wall 72 may be integrally formed with one or both of the first and second side walls 20, 22. As illustrated, the front wall 72 includes an upper portion 74 located at a top of the hinge receiver 18, a central portion 76, and a lower portion 78 located at bottom portion of the hinge receiver 18 and spaced apart from the central portion 76. Each of the upper and lower portions 74, 78 may be configured to be coupled with the front panel 14 of the appliance body 12 by one or more fasteners 84. The front wall 72 may extend along the entirety of the length of the side walls 20, 22 or along a portion of the length of the side walls 20, 22. In various examples, the upper portion 74 and/or the lower portion 78 may be integrally formed with the central portion 76. In other examples, the upper portion 74 and/or the lower portion 78 may be spaced apart from the central portion 76.

Figure 5:
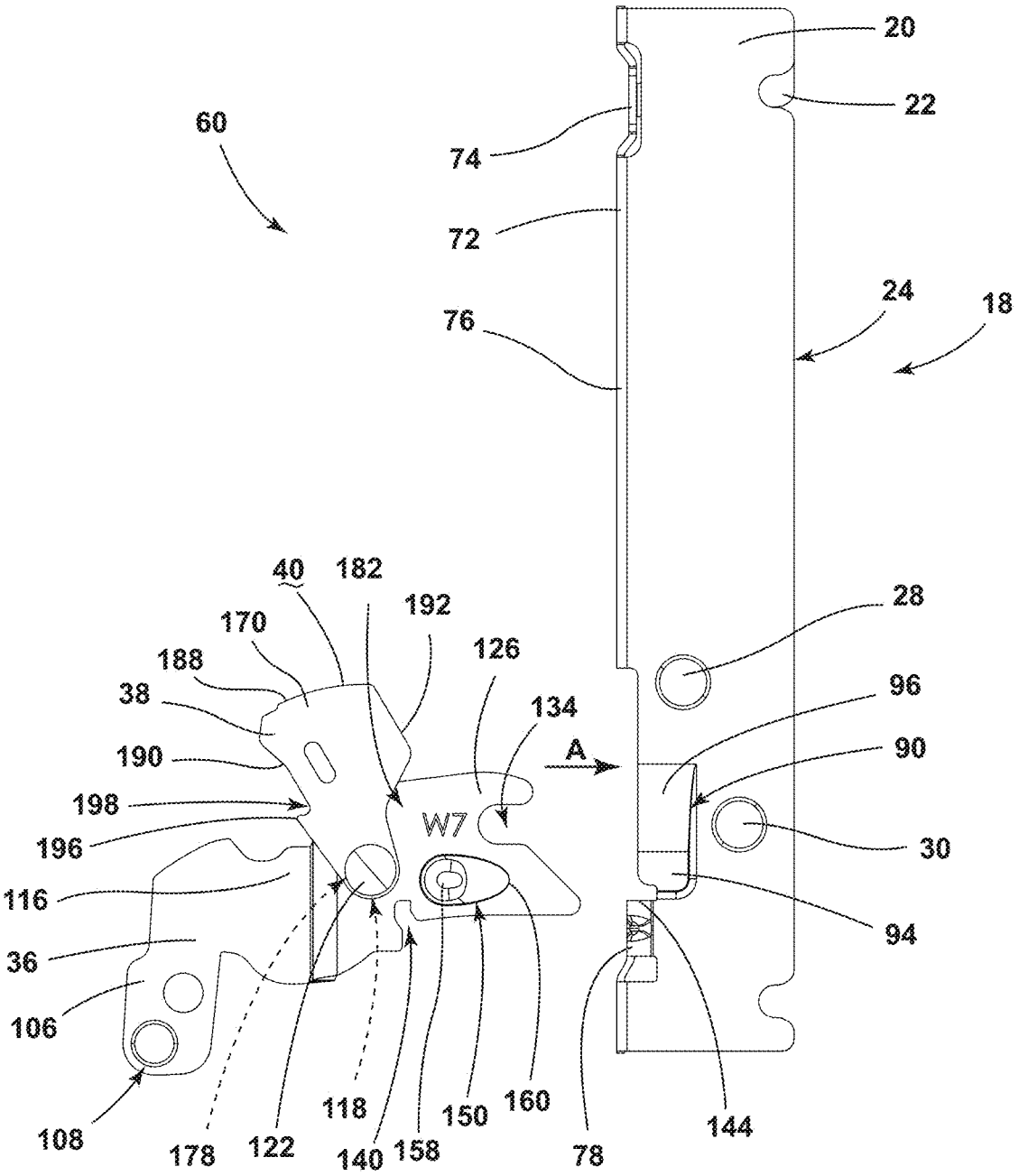
FIG. 5 is a side profile view of the hinge assembly of FIG. 1 removed from the cooking appliance with a hinge arm assembly spaced apart from a hinge receiver.

Referring now to FIGS. 4 and 5, the first side wall 20 includes a protrusion 90 extending into the receiving space 24. The protrusion 90 is positioned proximate a front edge of the first side wall 20 and has a vertical portion 94 and an inclined portion 96. The vertical portion 94 is spaced apart from the side wall 20, and the inclined portion 96 is inclined inward from the side wall 20 toward the vertical portion 94. As discussed in more detail elsewhere herein, the protrusion 90 may be configured to at least partially retain the hinge arm 36 within the receiving space 24 of the hinge receiver 18 and/or guide engagement of the hinge arm 36 into engagement with the hinge receiver 18. It is contemplated that each of the first and second side walls 20, 22 may include a respective protrusion 90. It is further contemplated that the protrusions 90 of the opposing side walls 20, 22 may be vertically aligned such that the width of the receiving space 24 defined between the first and second side walls 20, 22 is reduced between the protrusions 90 without departing from the scope of the present disclosure.

With continued reference to FIGS. 4 and 5, the first and second strikers 28, 30 are coupled with and extend between the first and second side walls 20, 22 of the hinge receiver 18. The first striker 28 may be positioned above the protrusion 90 of the first side wall 20, and the second striker 30 may be positioned rearward of the first striker 28 and the protrusion 90. The second striker 30 is further positioned below the first striker 28 such that the first striker 28 is vertically and horizontally offset from the second striker 30. In other words, the first striker 28 is positioned forward and upward from the second striker 30.

As previously introduced, the hinge arm assembly 34 includes the hinge arm 36 and the latch cam 38 configured to engage with the hinge receiver 18. A hinge body 100 of the hinge arm assembly 34 is fixedly coupled with the door 44. For example, the hinge body 100 may be coupled with one of the door panels 68, 70. The hinge body 100 may alternatively be coupled with a door support 104 between the door panels 68, 70 or along an edge of the door 44. The hinge body 100 is generally elongated and extends along a portion of the door 44 to rotate the door 44 between the open and closed positions. It is contemplated that the hinge body 100 may be at least partially positioned between the door panels 68, 70 without departing from the scope of the present disclosure. It is further contemplated that the hinge body 100 may be integrally formed with the door support 104 or may be formed as the door support 104 without departing from the scope of the present disclosure.

Referring now to FIGS. 4 and 5, the hinge body 100 is rotatably coupled with the hinge arm 36. As best shown in FIG. 5, the hinge arm 36 includes a door engagement portion 106. The door engagement portion 106 of the hinge arm 36 defines a door pin receiving well 108 configured to receive a door pin 110, as discussed in more detail elsewhere herein. The door pin 110 may be a fastener (e.g., a pin, a screw, a bolt, etc.) configured to couple the hinge body 100 with the hinge arm 36. The door axis X extends through a center of the door pin 110, as best shown in FIGS. 1 and 2, such that rotation of the hinge body 100 about the door pin 110 moves the door 44 between the open and closed positions about the door axis X.

Referring again to FIGS. 1-3, the hinge arm 36 is configured to be received by the connector slot 16 and extend into the receiving space 24 of the hinge receiver 18. As best shown in FIG. 5, the hinge arm 36 includes a body 116 defining an aperture 118. The aperture 118 is configured to receive a pin 122 configured to couple the latch cam 38 with the hinge arm 36. The pin 122 is configured such that the latch cam 38 is movable relative to the hinge arm 36 between engaged and disengaged positions.

Referring now to FIG. 5, as previously introduced, the hinge arm 36 includes a door engagement portion 106 extending from one side of the body 116. The hinge arm 36 further includes a coupling flange 126 extending from the body 116 in a direction generally opposite that of the door engagement portion 106. The coupling flange 126 is configured to be inserted through the connector slot 16 and into the receiving space 24 of the hinge receiver 18 (see FIGS. 4 and 6). The coupling flange 126 defines a striker receiving space 134 configured to at least partially receive the second striker 30 of the hinge receiver 18, as described in more detail below.

Figure 6:
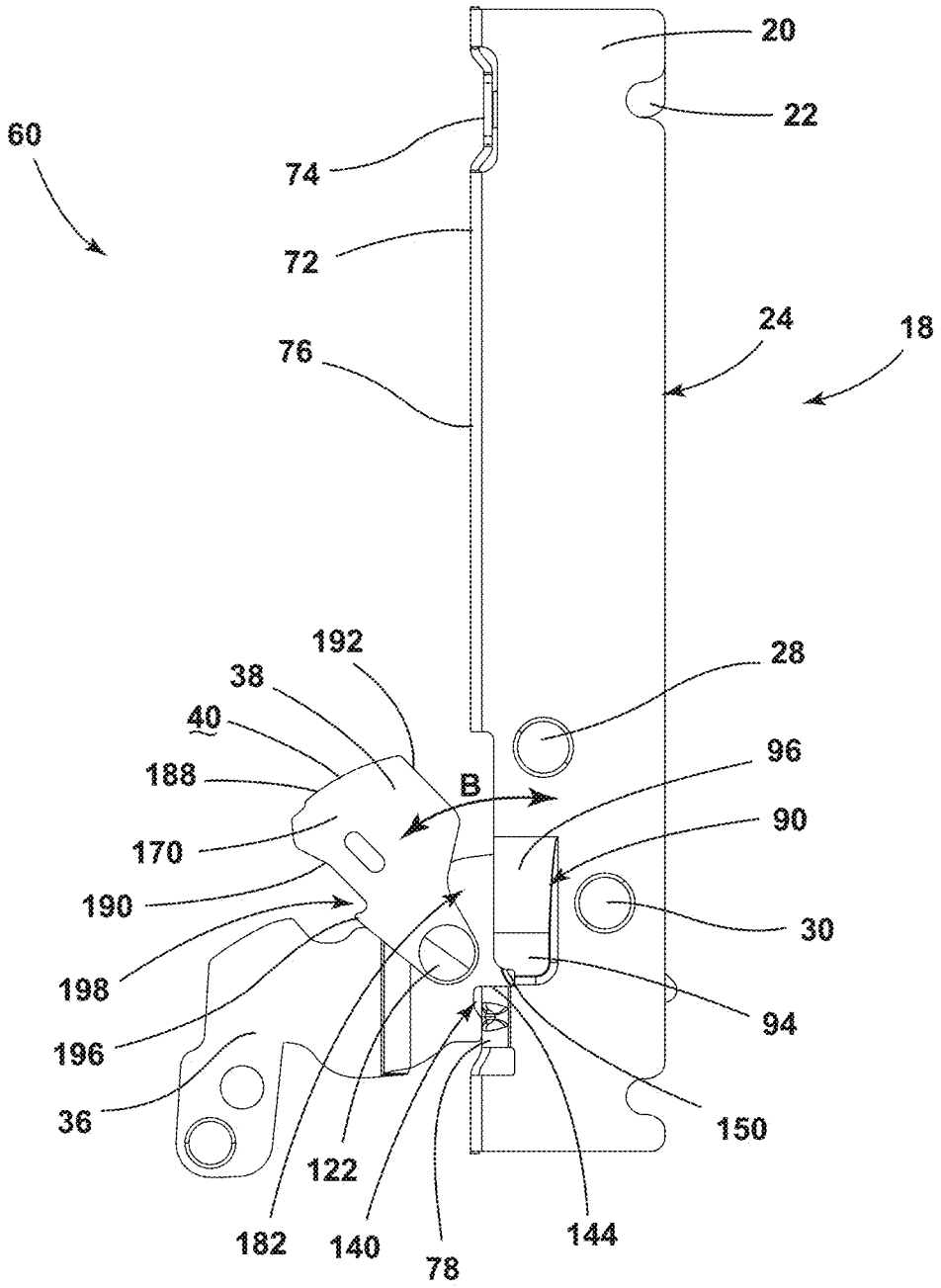
FIG. 6 is a side profile view of the hinge assembly of FIG. 5 with the hinge arm assembly received by the hinge receiver and a latch cam in a disengaged position.
Figure 7:
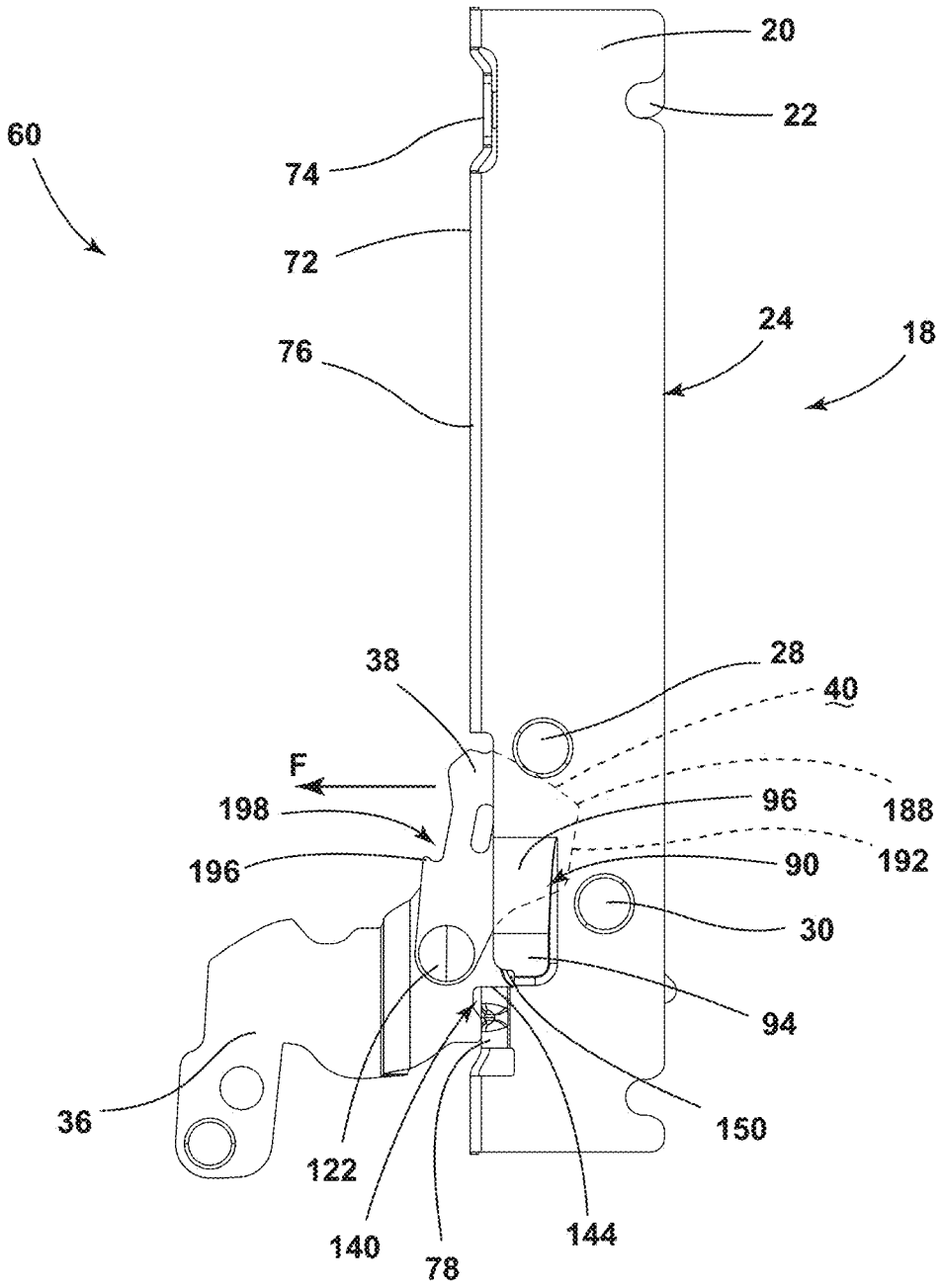
FIG. 7 is a side profile view of the hinge assembly of FIG. 5 with the hinge arm assembly received by the hinge receiver and a latch cam in an engaged position.

As shown in FIGS. 5-7, the coupling flange 126 is at least partially spaced apart from the body 116 of the hinge arm 36 by a slot 140, In other words, the hinge arm 36 defines a slot 140. The slot 140 is defined to extend vertically between the coupling flange 126 and the hinge arm 36 and is configured to receive a lower internal edge 144 of the front panel 14 when the hinge arm 36 is positioned through the connector slot 16 (see FIGS. 6 and 7). The engagement between the lower internal edge 144 and the slot 140 may be configured to increase the retention of the hinge arm 36 within the hinge receiver 18.

Referring again to FIGS. 4 and 5, the coupling flange 126 also includes a stop 150 extending outward from a side of the hinge arm 36. The stop 150 includes an abutment portion 158 and a tapered portion 160. The abutment portion 158 may be generally oblong or round or may have any other shape without departing from the scope of the present disclosure. The abutment portion 158 may be configured to be substantially planar or may be rounded. The tapered portion 160 extends from the abutment portion 158 toward the striker receiving space 134 and is tapered away from the abutment portion 158. As illustrated, the stop 150 may be shaped such that the tapered portion 160 is tapered inward toward a point and tapered downward from the abutment portion 158 to the surface of the hinge arm 36.

As best shown in FIG. 4, the stop 150 is configured to abut the protrusion 90 of the hinge receiver 18 when the hinge arm 36 is engaged with the hinge receiver 18. The tapered portion 160 allows the stop 150 to be positioned to contact the vertical portion 94 of the protrusion 90 of the hinge receiver 18. It is contemplated that the coupling flange 126 may have stops 150 on both sides of the hinge arm 36 such that the stops 150 engage with the protrusions 90 of each side wall 20, 22 of the hinge receiver 18.

Referring now to FIGS. 5-7, the latch cam 38 is rotatably coupled with the hinge arm 36 and includes a body portion 170 and a coupling portion 174. The coupling portion 174 extends from the body portion 170 and defines a receiving well 178. When the latch cam 38 is coupled with the hinge arm 36, the receiving well 178 is aligned with the aperture 118 of the hinge arm 36. The aperture 118 and the receiving well 178 are configured to receive the pin 122 such that the latch cam 38 is rotatable about the pin 122 relative to the hinge arm 36. The coupling portion 174 may extend from the body portion 170 such that the coupling portion 174 and the body portion 170 define a space 182 configured to at least partially receive the protrusion 90 of the hinge receiver 18 and the stop 150 of the hinge arm 36 when the latch cam 38 is in the engaged position.

Referring now to FIGS. 4 and 5, the latch cam 38 further includes an upper edge 188 extending between a front edge 190 and a rear edge 192. The front edge 190 of the latch cam 38 extends along the body portion 170 and the coupling portion 174. As previously introduced, the upper edge 188 includes the top surface 40 of the latch cam 38. The upper edge 188 may be non-linear such that the body portion 170 is more narrow proximate the rear edge 192 than proximate the front edge 190. In various examples, material may be added to the latch cam 38 proximate the rear edge 192 to shift the center of gravity of the latch cam 38 to retain the latch cam 38 in the engaged position.

The front edge 190 of the latch cam 38 further includes a tab 196 extending outward from the latch cam 38. The tab 196 defines a notch 198 configured to be used as a pull tab to move the latch cam 38 from the engaged position to the disengaged position to remove the hinge arm assembly 34 from engagement with the hinge receiver 18, as discussed in more detail elsewhere herein. The tab 196 may be generally rounded and may define the notch 198 to receiver a user's finger, a standard tool, or any other mechanism for applying a pulling force F (see FIG. 7) to the latch cam 38, The tab 196 of the latch cam 38 may further be configured to allow the latch cam 38 to be moved between the engaged and disengaged positions without a specialized tool.

As shown in FIG. 5, the hinge arm 36 is inserted into the receiving space 24 of the hinge receiver 18 proximate the first and second strikers 28, 30 (see arrow A). The coupling flange 126 is aligned with the second striker 30, and the striker receiving space 134 is configured to receive the second striker 30. As shown in FIGS. 6 and 7, when the coupling flange 126 is inserted into the receiving space 24, the lower internal edge of the hinge receiver 144 is received by the slot 140 and may be configured to retain the hinge arm 36 in engagement with the hinge receiver 18. The latch cam 38 is then rotated (see arrow B of FIG. 6) from the disengaged position (FIG. 6) to the engaged position (FIG. 7).

As best shown in FIG. 4, when the latch cam 38 is in the engaged position, the top surface 40 of the upper edge 188 is configured to abut the first striker 28. When the latch cam 38 is rotated from the disengaged position to the engaged position, the top surface 40 of the upper edge 188 slides under the first striker 28. The engagement of the first striker 28 with the top surface 40 is configured to at least partially retain the latch cam 38 in the engaged position. The non-linear shape of the upper edge 188 and the top surface 40 of the latch cam 38 may further be configured to provide a self-guided engagement of the latch cam 38, and the hinge arm assembly 34, with the hinge receiver 18. As previously discussed, the latch cam 38 may be configured to position a center of gravity of the latch cam 38 to maintain the engagement between the latch cam 38 and the hinge receiver 18 to prevent inadvertent release of the latch cam 38.

The use of the hinge assembly 60 including the hinge receiver 18 and the hinge arm assembly 34 provides contact between the latch cam 38 and the first striker 28. The contact between the latch cam 38 and the first striker 28 may be configured to maintain engagement between the hinge receiver 18 and the hinge arm assembly 34. For example, the contact may be configured to prevent lifting of the hinge arm 36 in the connector slot 16 when the door 44 is moved from the open position to the closed position.

According to one aspect, an appliance includes an appliance body having a front panel defining a connector slot. A hinge receiver is coupled with the appliance body and has opposing side walls defining a receiving space therebetween. The hinge receiver includes a first striker positioned above a second striker. The first and second strikers are aligned with the connector slot. A hinge arm assembly includes a hinge arm configured to engage with the second striker and a latch cam hingedly coupled with the hinge arm. The latch cam is movable between an engaged position and a disengaged position, and a top surface of the latch cam abuts the first striker in the engaged position. A door is rotatably coupled with the appliance body by the hinge receiver and the hinge assembly and is rotatable about a door axis between open and closed positions.

According to another aspect, a first striker is offset from a second striker.

According to another aspect, a latch cam is weighted to prevent inadvertent movement of the latch cam from an engaged position to a disengaged position.

According to another aspect, a hinge body is coupled with a door and is rotatably coupled with a hinge arm by a fastener, and a door axis extends through the fastener.

According to another aspect, a latch cam includes a tab configured to receive a pulling force to move the latch cam from an engaged position to a disengaged position.

According to another aspect, a hinge receiver includes a lower internal edge proximate at least one of first and second strikers.

According to another aspect, a hinge arm defines a slot configured to receive a lower internal edge of a hinge receiver.

According to another aspect, an appliance includes an appliance body having a front panel defining a connector slot. A hinge receiver is coupled with the front panel and includes first and second strikers aligned with the connector slot. The first striker is positioned above and forward of the second striker. A door is coupled with the appliance body and is movable between open and closed positions. A hinge body is coupled with the door, and a hinge arm is coupled with the hinge body and configured to engage with the second striker, A latch cam is operably coupled with the hinge arm and is movable between an engaged position and a disengaged position. A top surface of the latch cam abuts the first striker in the engaged position.

According to another aspect, a latch cam includes a body having a front edge and a rear edge and is gravity biased toward the rear edge in an engaged position.

According to another aspect, a latch cam includes a tab configured to receive a pulling force to move the latch cam from an engaged position to a disengaged position.

According to another aspect, a hinge arm defines a slot configured to receive a lower internal edge of a hinge receiver.

According to another aspect, a hinge arm defines a receiving space configured to at least partially receive a second striker.

According to another aspect, a hinge arm includes a stop tapered toward a receiving space of the hinge arm.

According to another aspect, a hinge receiver includes a side wall having a protrusion configured to contact a stop when a second striker is received by a receiving space of a hinge arm.

According to another aspect, a hinge assembly for an appliance includes a hinge receiver including first and second strikers. The first striker is positioned above and forward of the second striker, A hinge arm defines a receiving space configured to receive the second striker. A hinge body is rotatably coupled with the hinge arm, and a latch cam is operably coupled with the hinge arm. The latch cam is movable between an engaged position and a disengaged position. A top surface of the latch cam abuts the first striker in the engaged position.

According to another aspect, a top surface of a latch cam extends along a non-linear upper edge.

According to another aspect, a latch cam includes a tab extending forward of the latch cam.

According to another aspect, a hinge arm includes a stop having a first portion tapered away from a second portion.

According to another aspect, a hinge receiver includes a side wall having a protrusion configured to contact a second portion of a stop when a second striker is received by a hinge arm.

According to another aspect, a hinge receiver is coupled with a front panel of an appliance body and is positioned to align first and second strikers with a connector opening of the front panel.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members, or connector, or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance comprising:

an appliance body including a front panel defining a connector slot;

a hinge receiver coupled with the appliance body and having opposing side walls defining a receiving space therebetween, wherein the hinge receiver includes a first striker positioned above a second striker, wherein the first and second strikers are aligned with the connector slot;

a hinge arm assembly including a hinge arm configured to engage with the second striker and a latch cam hingedly coupled with the hinge arm, wherein a front edge of the latch cam includes a tab that defines a notch on the front edge of the latch cam, and further wherein the latch cam is movable between an engaged position and a disengaged position, and a top surface of the latch cam abuts the first striker in the engaged position; and a door rotatably coupled with the appliance body by the hinge receiver and the hinge arm assembly, wherein the door is rotatable about a door axis between open and closed positions.

2. The appliance of claim 1, wherein the first striker is offset from the second striker.

3. The appliance of claim 1, wherein the latch cam is weighted to prevent inadvertent movement of the latch cam from the engaged position to the disengaged position.

4. The appliance of claim 1, wherein a hinge body is coupled with the door and is rotatably coupled with the hinge arm by a fastener, the door axis extending through the fastener.

5. The appliance of claim 1, wherein the tab configured to receive a pulling force to move the latch cam from the engaged position to the disengaged position.

6. The appliance of claim 1, wherein the hinge receiver includes a lower internal edge proximate at least one of the first and second strikers.

7. The appliance of claim 6, wherein the hinge arm defines a slot configured to receive the lower internal edge.

8. An appliance comprising:

an appliance body including a front panel defining a connector slot;

a hinge receiver coupled with the front panel and including first and second strikers aligned with the connector slot, wherein the first striker is positioned above and forward of the second striker;

a door coupled with the appliance body and movable between open and closed positions;

a hinge body coupled with the door;

a hinge arm coupled with the hinge body and configured to engage with the second striker, wherein the hinge arm defines a receiving space configured to at least partially receive the second striker, and wherein the hinge arm includes a stop tapered toward the receiving space of the hinge arm; and a latch cam operably coupled with the hinge arm and movable between an engaged position and a disengaged position, wherein a top surface of the latch cam abuts the first striker in the engaged position.

9. The appliance of claim 8, wherein the latch cam includes a body having a front edge and a rear edge, and further wherein the latch cam is gravity biased toward the rear edge in the engaged position.

10. The appliance of claim 8, wherein the latch cam includes a tab configured to receive a pulling force to move the latch cam from the engaged position to the disengaged position.

11. The appliance of claim 8, wherein the hinge arm defines a slot configured to receive a lower internal edge of the hinge receiver.

12. The appliance of claim 8, wherein the hinge receiver includes a side wall having a protrusion configured to contact the stop when the second striker is received by the receiving space.

13. A hinge assembly for an appliance, comprising:

a hinge receiver including first and second strikers, wherein the first striker is positioned above and forward of the second striker;

a hinge arm defining a receiving space configured to receive the second striker, wherein the hinge arm includes a stop having a first portion tapered away from a second portion;

a hinge body rotatably coupled with the hinge arm; and a latch cam operably coupled with the hinge arm and movable between an engaged position and a disengaged position, wherein a top surface of the latch cam abuts the first striker in the engaged position.

14. The hinge assembly of claim 13, wherein the top surface of the latch cam extends along a non-linear upper edge.

15. The hinge assembly of claim 13, wherein the latch cam includes a tab extending forward of the latch cam.

16. The hinge assembly of claim 13, wherein the hinge receiver includes a side wall having a protrusion, and further wherein the protrusion is configured to contact the second portion of the stop when the second striker is received by the hinge arm.

17. The hinge assembly of claim 13, wherein the hinge receiver is coupled with a front panel of an appliance body and is positioned to align the first and second strikers with a connector opening of the front panel.

* * * * *